US011756777B2

(12) United States Patent
Field et al.

(10) Patent No.: US 11,756,777 B2
(45) Date of Patent: *Sep. 12, 2023

(54) HUMIDIFICATION OF LASER ABLATED SAMPLE FOR ANALYSIS

(71) Applicant: Elemental Scientific, Inc., Omaha, NE (US)

(72) Inventors: Michael P. Field, Papillion, NE (US); Jude Sakowski, Omaha, NE (US); Jordan Krahn, Omaha, NE (US); Ciaran J. O'Connor, Bozeman, MT (US)

(73) Assignee: Elemental Scientific Inc., Omaha, NE (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/543,926

(22) Filed: Dec. 7, 2021

(65) Prior Publication Data

US 2022/0172939 A1 Jun. 2, 2022

Related U.S. Application Data

(63) Continuation of application No. 16/997,349, filed on Aug. 19, 2020, now Pat. No. 11,195,708.

(60) Provisional application No. 62/888,768, filed on Aug. 19, 2019.

(51) Int. Cl.
*H01J 49/04* (2006.01)

(52) U.S. Cl.
CPC ..... *H01J 49/0418* (2013.01)

(58) Field of Classification Search
CPC ..... H01J 49/0418
See application file for complete search history.

(56) References Cited

U.S. PATENT DOCUMENTS

| | | | | |
|---|---|---|---|---|
| 11,195,708 | B2 * | 12/2021 | Field | H01J 49/0418 |
| 2003/0082825 | A1 | 5/2003 | Lee et al. | |
| 2014/0224775 | A1 | 8/2014 | Sharp et al. | |

FOREIGN PATENT DOCUMENTS

| | | | |
|---|---|---|---|
| JP | 2005272898 | A | 10/2005 |
| KR | 20060021749 | A | 3/2006 |
| WO | 2017194972 | A1 | 11/2017 |

OTHER PUBLICATIONS

Notification of Transmittal of the International Search Report and the Written Opinion of the international Searching Authority, or the Declaration dated Nov. 27, 2020 for App. No. PCT/US20/46975.

* cited by examiner

*Primary Examiner* — Nicole M Ippolito
*Assistant Examiner* — Hanway Chang
(74) *Attorney, Agent, or Firm* — Kevin E. West; Advent, LLP

(57) ABSTRACT

Humidification systems and methods to introduce water vapor to a laser-ablated sample prior to introduction to an ICP torch are described. A system embodiment includes, but is not limited to, a water vapor generator configured to control production of a water vapor stream and to transfer the water vapor stream to at least one of a sample chamber of a laser ablation device or a mixing chamber in fluid communication with the laser ablation device, wherein the mixing chamber is configured to receive a laser-ablated sample from the laser ablation device and direct the laser-ablated sample to an inductively coupled plasma torch.

18 Claims, 4 Drawing Sheets

HUMIDIFICATION OF LASER ABLATED SAMPLE FOR ANALYSIS

BACKGROUND

Laser Ablation Inductively Coupled Plasma Mass Spectrometry (LA-ICPMS) or Laser ablation Inductively Coupled Plasma Optical Emission Spectrometry (LA-ICP-OES) techniques can be used to analyze the composition of a target (e.g., a solid or liquid target material). Often, a sample of the target is provided to an analysis system in the form of an aerosol (i.e., a suspension of solid and possibly liquid particles and/or vapor in a carrier gas, such as helium gas). The sample is typically produced by arranging the target within a laser ablation chamber, introducing a flow of a carrier gas within the chamber, and ablating a portion of the target with one or more laser pulses to generate a plume containing particles and/or vapor ejected or otherwise generated from the target, suspended within the carrier gas. Entrained within the flowing carrier gas, the target material is transported to an analysis system via a transport conduit to an ICP torch where it is ionized. A plasma containing the ionized particles and/or vapor is then analyzed by an analysis system, such as an MS, OES, isotope ratio mass spectrometry (IRMS), or electro-spray ionization (ESI) system.

SUMMARY

This Summary is provided to introduce a selection of concepts in a simplified form that are further described below in the Detailed Description. This Summary is not intended to identify key and/or essential features of the claimed subject matter. Also, this Summary is not intended to limit the scope of the claimed subject matter in any manner.

Aspects of the disclosure relate to a humidification system to introduce water vapor to a laser-ablated sample prior to introduction to an ICP torch. A system embodiment includes, but is not limited to, a water vapor generator configured to control production of a water vapor stream and to transfer the water vapor stream to at least one of a sample chamber of a laser ablation device or a mixing chamber in fluid communication with the laser ablation device, wherein the mixing chamber is configured to receive a laser-ablated sample from the laser ablation device and direct the laser-ablated sample to an inductively coupled plasma torch.

DRAWINGS

The Detailed Description is described with reference to the accompanying figures.

DETAILED DESCRIPTION

Overview

Elemental mass bias observed during Laser Ablation Inductively Coupled Plasma Mass Spectrometry (LA-ICPMS) can be attributed to three primary sources: (1) in the laser cell during ablation, (2) in the plasma during ionization, and (3) in the mass spectrometer during ion extraction and transmission. The third source is due to preferential ion transmission, whereas the first source is due to the ablation process and the second source is due to dry plasma conditions. Samples are traditionally introduced to the ICP torch as a dry aerosol, without significant amounts of water vapor or moisture present within the sample. When a dry sample is introduced to the ICP torch, the ionization zone for the plasma is narrow with a high energy. Elements of interest that ionize in plasma will ionize in different locations in the plasma and are sampled differently, resulting in an elemental mass bias reflected during detection of the concentrations of ions. For example, uranium and thorium will ionize in different locations in a plasma, where detection instrumentation can detect the presence of the ions with different sensitivities. For instance, the plasma may not be tuned to detect uranium and thorium with equal sensitivity when a dry aerosol is introduced, due in part to the narrow ionization zone of the plasma and the different regions of ionization of the elements in the plasma.

Accordingly, systems and methods are disclosed for humidification of a laser-ablated sample prior to introduction of the sample to a plasma source. The amount of water vapor introduced to the laser-ablated sample is precisely controlled to provide significant increases in sensitivity of detection of analytes of interest without significant increases in oxide formation during analysis. In an implementation, a syringe injector and desolvation unit generates a precisely controlled water vapor stream for addition to an aerosol stream from a laser ablation system.

Other systems have added water to a laser ablation stream by nebulizing solution in a spray chamber to form fine water aerosol droplets, whereas the present system can introduce water vapor into the laser ablation stream. Membrane-based desolvation systems have been used in the past to dry a wet sample stream and/or to add internal/calibration standards to the laser stream. In such instances, water vapor was removed and not added to the laser stream. In the present system, the removed water vapor can be added to the laser-ablation gas stream in a precisely controlled fashion.

Example Implementations

Figure 1:
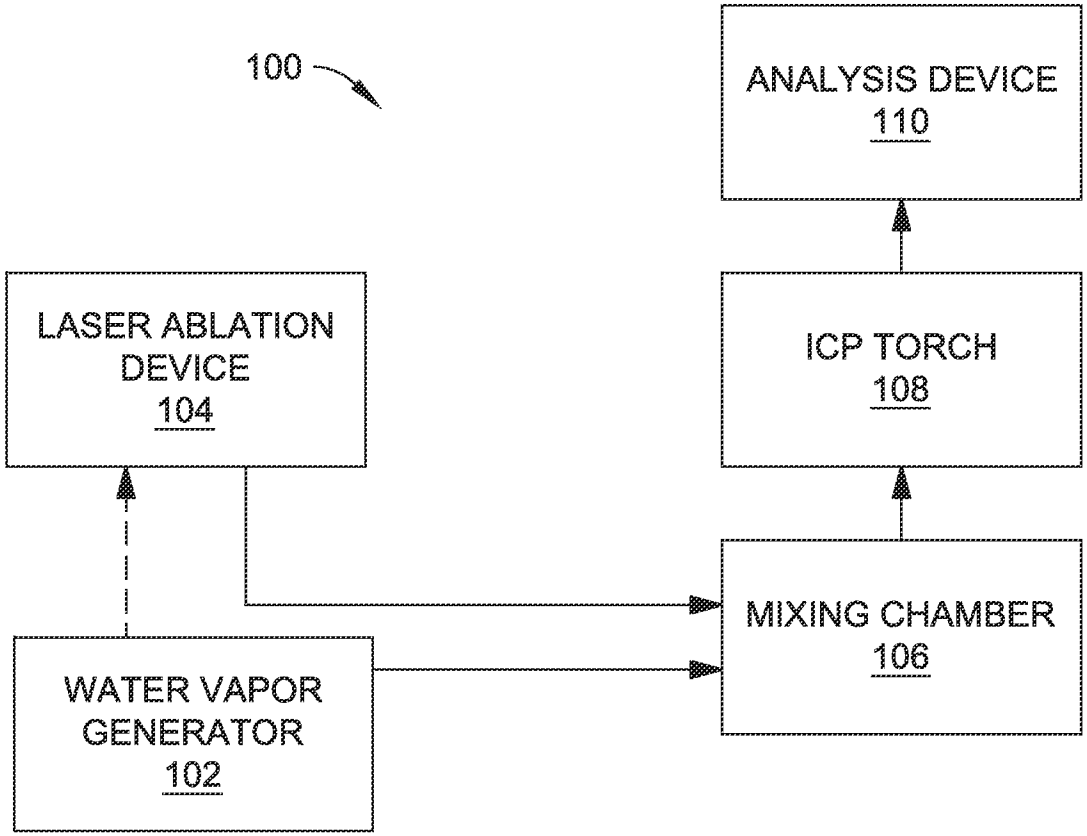
FIG. 1 is a schematic view of a laser-ablation-based analytical system including a humidification system in accordance with an example embodiment of the present disclosure.

FIG. 1 illustrates a laser-ablation-based analytical system 100, according to an example implementation of the present disclosure. The laser-ablation-based analytical system 100 generally includes a water vapor generator 102, a laser ablation device 104, a mixing chamber 106, an ICP torch 108, and an analysis device 110, fluidly interconnected as appropriate to facilitate transfer of components through the system 100. The water vapor generator 102 is configured to generate a precisely controlled stream of water vapor to be introduced to one or more of the laser ablation device 104 and the mixing chamber 106. When introduced to the laser ablation device 104, the water vapor provides humid conditions in the sample chamber under which the ablation process operates to reduce the effects of mass bias during the ablation process. When introduced to the mixing chamber 106, the water vapor stream from the water vapor generator 102 can mix with the sample aerosol stream from the laser ablation device 104 to generate a humidified sample stream to be introduced to the ICP torch 108 for ionization and transfer into the analysis device 110 (e.g., MS, AES, OES, IRMS, ESI system, etc.). The humidified sample can provide the plasma characteristics of a wet plasma, such as broadening the ionization zone as compared to a dry plasma ionization zone. For example, in a sample containing thorium and uranium, the elements now ionize in the same area of the plasma, allowing for increased sensitivity for each of thorium and uranium as compared to the narrow ionization zone produced in a dry plasma. The mixing chamber 106 can introduce other fluid streams to the sample aerosol stream including, but not limited to, one or more sample gases to facilitate transfer to the ICP torch (e.g., argon, nitrogen, etc.).

The water vapor generator 102 can utilize heat to provide a water vapor stream for introduction to the mixing chamber 106, to the laser ablation device 104, or combinations thereof. The water vapor generator 102 can include a syringe injector or syringe pump to provide control of microliter-levels of water introduction to provide improved trace metal sensitivity while avoiding significant generation of metal oxides at the ICP torch 108. In implementations, the water vapor generator 102 can include one or more of a heated spray chamber, an APEX desolvation nebulizer (Elemental Scientific, Omaha, Nebr.), or a PERGO argon nebulizer gas humidifier (Elemental Scientific, Omaha, Nebr.) to provide the control of water vapor generation. Examples of APEX-related desolvation systems are disclosed in U.S. Pat. No. 6,864,974, and 10,497,550, the contents of each hereby incorporated by reference thereto. In an embodiment, the water vapor generator 102 can be a heating and condensing desolvation system.

The water vapor can be added at any point in the laser gas flow, for example, before the cell, after the cell, anywhere in the transfer line, at the torch, and/or into the injector. Further, an internal standard and/or a calibration standard solution can be added to the solution aspirated and, by extension, thus added to the laser aerosol stream, for example, to create a calibration curve. In an embodiment, the water vapor generator 102 can be integrated or partially integrated with the laser-ablation-based analytical system 100. In an embodiment, software controlling operation of the water vapor generator 102 can be integrated into software controlling the laser-ablation-based analytical system 100.

Figure 2:
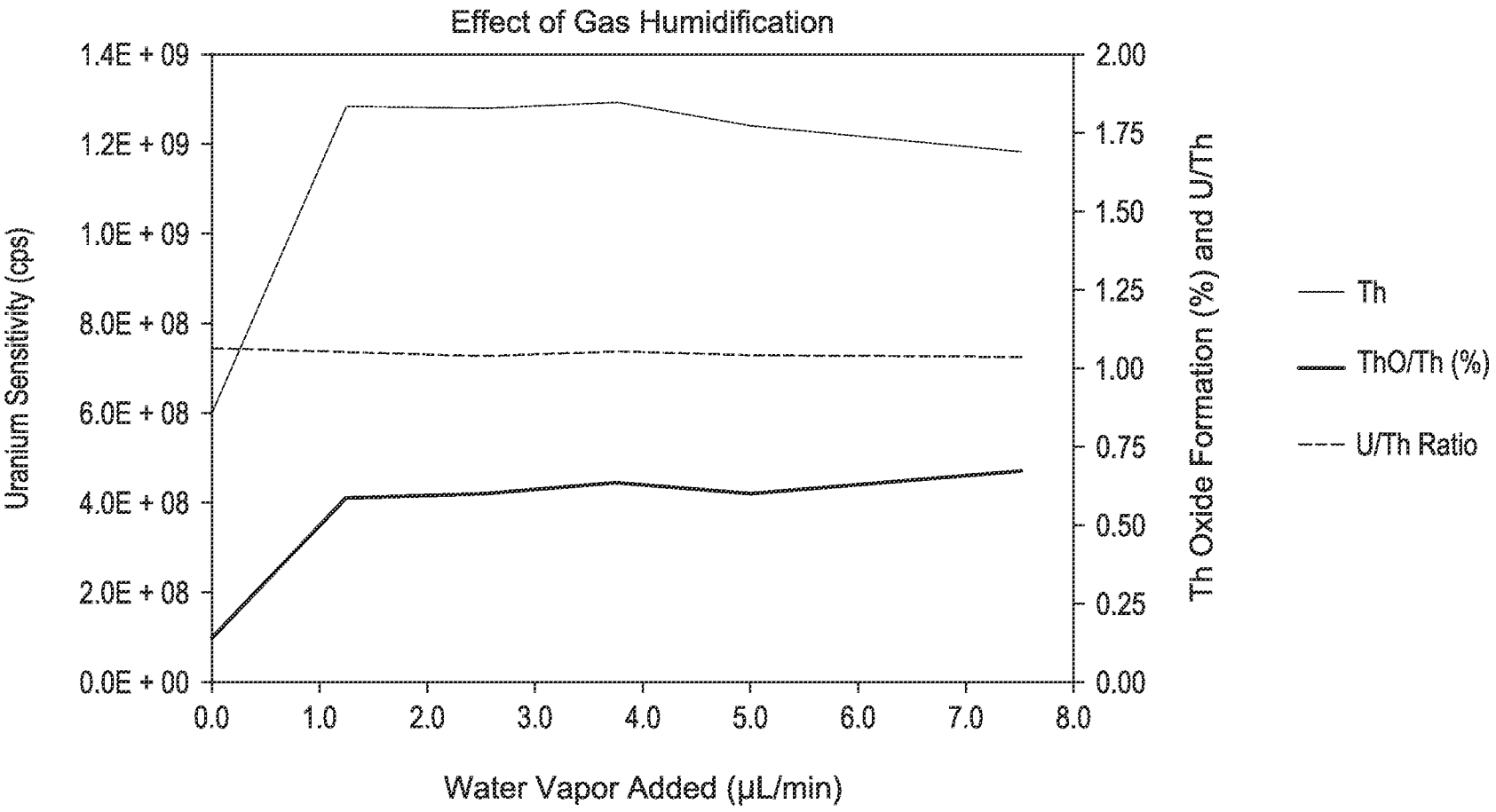
FIG. 2 is a chart illustrating uranium sensitivity, thorium oxide generation, and uranium to thorium ratio versus water vapor added to a laser-ablated sample in accordance with an example embodiment of the present disclosure.

Referring to FIG. 2, a chart illustrating the effect of humidification of a laser-ablated sample during a series of analyses is shown. During the analyses, a mass spectrometer was tuned for minimal mass bias by adjusting the uranium to thorium (U/Th) ratio to 1 in MIST 610. Water vapor was added to the ablated sample from 1 μL/min to 10 μL/min, with the uranium sensitivity and thorium oxide generation monitored to determine overall improvement in analyses following water vapor addition. The chart in FIG. 2 shows (1) uranium sensitivity on the left axis as a result of increasing water vapor added (from no water vapor added to up to 8 μL/min added); (2) thorium oxide generation on the right axis as a result of increasing water vapor added (shown as a ratio of thorium oxide to thorium); and (3) a ratio of uranium to thorium detected. As shown, the sensitivity increase for uranium was significant for all water amount added, with only slight increases in oxide formation, while maintaining the U/Th ratio at 1.

Figure 3:
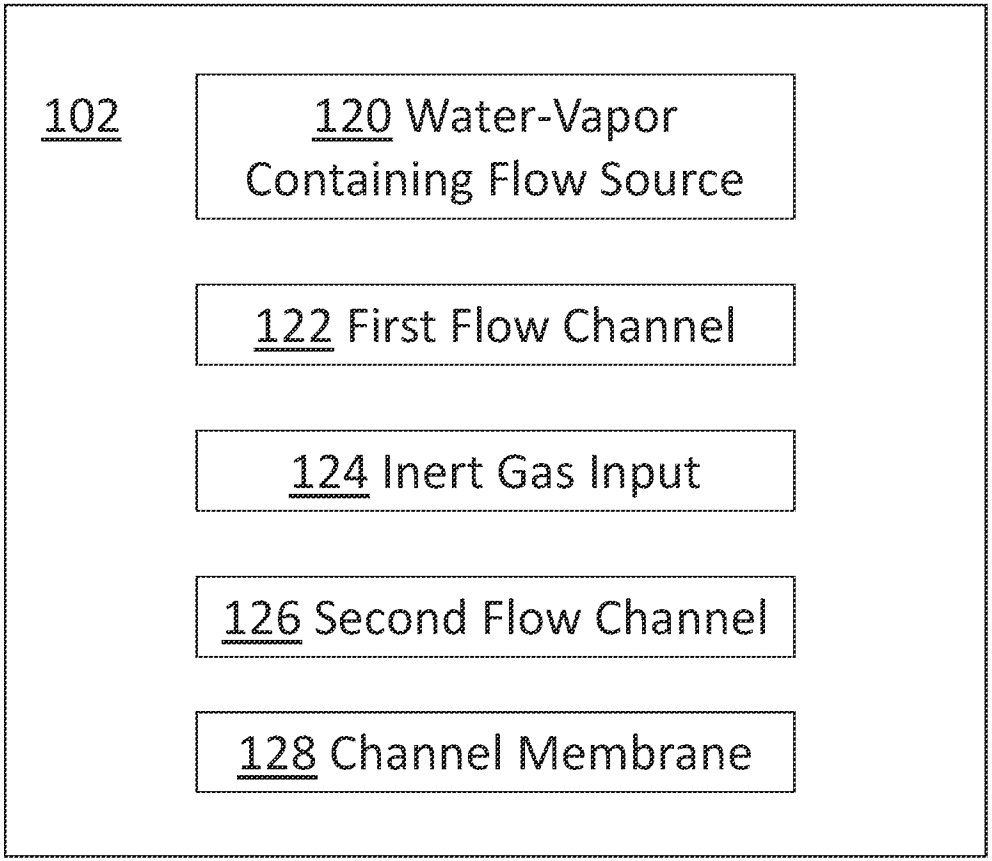
FIG. 3 is a schematic view of the water vapor generator of the laser-ablation-based analytical system shown in FIG. 1.

In an embodiment schematically shown in FIG. 3, the water vapor generator 102 can include a water-vapor containing flow source 120, a first flow channel 122, an inert gas input 124, a second flow channel 126, and a channel membrane 128. The water-vapor containing flow source 120 can be configured to provide a flow of a water-vapor containing flow into the first flow channel 122. The water-vapor containing flow may further contain one or more analytes for dry evaluation, for example, by the ICP system (i.e., upon removal of the water therefrom). The second flow channel 126 can be configured to receive a flow of an inert gas (e.g., He, Ar, and/or $N_2$) from the inert gas input 124 (e.g., a direct input from a source or a flow thereof from a remote source), with the inert gas configured to act as a transfer and/or carrier gas for the laser ablation process. The first flow channel 122 can be separated from the second flow channel 126 by the channel membrane 128. The channel membrane 128 can be a selectively permeable membrane, such as a membrane made of an expanded polytetrafluoroethylene (EPTFE). In an embodiment, the channel membrane 128 is permeable to the solvent (e.g., water) upon saturation with the solvent but not substantially permeable to any analytes of interest (e.g., potassium and/or other metallic ions) otherwise provided by the water-vapor containing flow source 120. In an embodiment, the first flow channel 122 can be located within the second flow channel 126. In an embodiment, the first flow channel 122 may be concentrically located with the second flow channel 126. In an embodiment, the water vapor penetrating or otherwise crossing the channel membrane 128 can mix with and humidify the inert gas streaming in the second flow channel 126. The humidified inert gas stream can then be used as part of a laser ablation procedure. In an embodiment, the first flow channel 122 can be configured to direct its flow a mixing chamber (e.g., the mixing chamber 106). In an embodiment, the second flow channel 126 can be configured to direct its flow (e.g., the combination of the transfer gas and the water vapor) to the mixing chamber 106 and/or a sample chamber (not shown) of the laser ablation device 104.

Various mechanisms can be used for controlling the amount of water vapor introduced into the inert gas stream. In an embodiment, the amount of water vapor added using the water vapor generator 102 can be controlled over a range of 1 to 100 μL/min using, for example, a syringe-controlled delivery of solution. In an embodiment, the amount of water vapor added to the inert gas stream can be controlled over a range of 1 to 100 μL/min by varying the temperature of the solution used for the water-vapor containing flow source 120. In an embodiment, the amount of water of water vapor added can be controlled over a range of 1 to 100 μL/min by varying the flow rate of the inert gas within the second flow channel 126.

Figure 4:
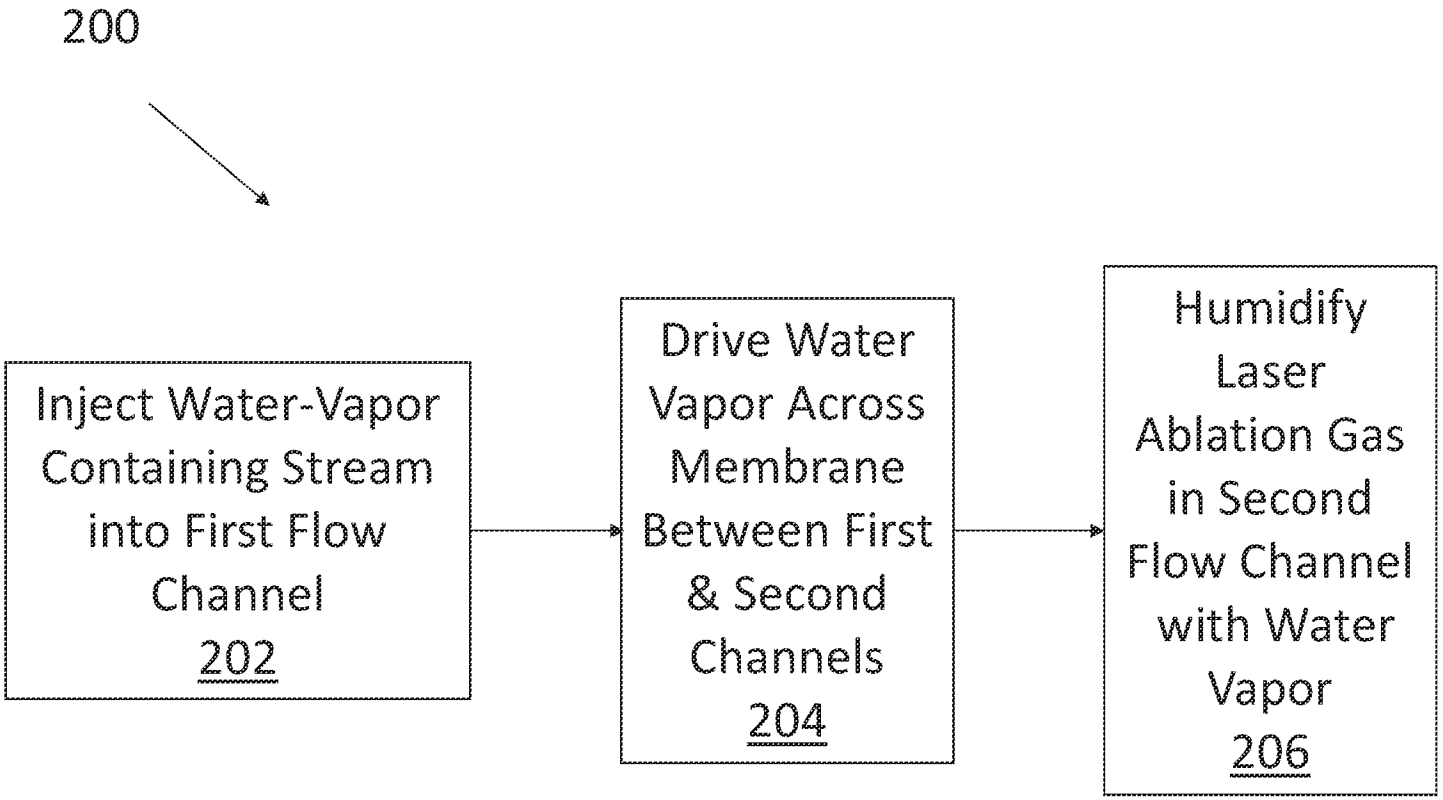
FIG. 4 is a flow diagram schematically illustrating the operation of the water vapor generator shown in FIG. 3.

FIG. 4 illustrates a water vapor generation process 200, which may be achieved, for example, by the water vapor generator 102. The water vapor generation process 200 can include a first step 202 of injecting a water-vapor containing stream into a first flow channel; a second step 204 of driving water vapor from the water-vapor containing stream across a membrane between the first flow channel and a second flow channel; and a third step 206 of humidifying laser ablation gas (e.g., He, Ar, $N_2$, or a mixture of two or more such gases) in the second flow channel with the water vapor received through the membrane. The humidified laser ablation gas (e.g., a combination of a chosen inert gas and the water vapor) can then be used as part of a laser ablation process associated with the operation of the laser-ablation-based analytical system 100.

The laser-ablation-based analytical system 100 or portions thereof may be controlled by a computing system having a processor configured to execute computer readable program instructions (i.e., the control logic) from a non-transitory carrier medium (e.g., storage medium such as a flash drive, hard disk drive, solid-state disk drive, SD card, optical disk, or the like). The computing system can be connected to various components of the analytic system, either by direct connection, or through one or more network connections (e.g., local area networking (LAN), wireless area networking (WAN or WLAN), one or more hub connections (e.g., USB hubs), and so forth). For example, the computing system can be communicatively coupled (e.g., hard-wired or wirelessly) to the controllable elements (e.g., controllable valves, syringe pumps, heating devices, cooling devices, and/or mass flow controllers) of the laser-ablation-based analytical systems shown in FIG. 1. The program instructions, when executing by the processor, can cause the computing system to control the given laser-ablation-based analytical system. In an implementation, the program instructions form at least a portion of software programs for execution by the processor.

In embodiments, the computing system (e.g., system controller) of the laser-ablation-based analytical system 100 can include a processor, a memory, and a communications interface. The processor can provides processing functionality for at least the computing system and can include any number of processors, micro-controllers, circuitry, field programmable gate array (FPGA) or other processing systems, and resident or external memory for storing data, executable code, and other information accessed or generated by the controller. The processor can execute one or more software programs embodied in a non-transitory computer readable medium that implement techniques described herein. The processor is not limited by the materials from which it is formed or the processing mechanisms employed therein and, as such, can be implemented via semiconductor(s) and/or transistors (e.g., using electronic integrated circuit (IC) components), and so forth.

The memory can be an example of tangible, computer-readable storage medium that provides storage functionality to store various data and or program code associated with operation of the controller, such as software programs and/or code segments, or other data to instruct the processor, and possibly other components of the system 100, to perform the functionality described herein. Thus, the memory can store data, such as a program of instructions for operating the system 100 (including its components), and so forth. It should be noted that while a single memory is described, a wide variety of types and combinations of memory (e.g., tangible, non-transitory memory) can be employed. The memory can be integral with the processor, can comprise stand-alone memory, or can be a combination of both.

Some examples of the memory can include removable and non-removable memory components, such as random-access memory (RAM), read-only memory (ROM), flash memory (e.g., a secure digital (SD) memory card, a mini-SD memory card, and/or a micro-SD memory card), magnetic memory, optical memory, universal serial bus (USB) memory devices, hard disk memory, external memory, remove (e.g., server and/or cloud) memory, and so forth. In implementations, memory can include removable integrated circuit card (ICC) memory, such as memory provided by a subscriber identity module (SIM) card, a universal subscriber identity module (USIM) card, a universal integrated circuit card (UICC), and so on.

The communications interface can be operatively configured to communicate with selected components of the laser-ablation-based analytical system 100. For example, the communications interface can be configured to transmit data for storage by the laser-ablation-based analytical system 100, retrieve data from storage, and so forth. The communications interface can also be communicatively coupled with the processor to facilitate data transfer between components of the laser-ablation-based analytical system 100 and the processor. It should be noted that while the communications interface is described as a component of controller, one or more components of the communications interface can be implemented as external components communicatively coupled to the laser-ablation-based analytical system 100 or components thereof via a wired and/or wireless connection. The laser-ablation-based analytical system 100 or components thereof can also include and/or connect to one or more input/output (I/O) devices (e.g., via the communications interface), such as a display, a mouse, a touchpad, a touchscreen, a keyboard, a microphone e.g., for voice commands) and so on.

The communications interface and/or the processor can be configured to communicate with a variety of different networks, such as a wide-area cellular telephone network, such as a cellular network, a 3G cellular network, a 4G cellular network, a 5G cellular network, or a global system for mobile communications (GSM) network; a wireless computer communications network, such as a WiFi network (e.g., a wireless local area network (WLAN) operated using IEEE 802.11 network standards); an ad-hoc wireless network, an internet; the Internet; a wide area network (WAN); a local area network (LAN); a personal area network (PAN) (e.g., a wireless personal area network (WPAN) operated using IEEE 802.15 network standards); a public telephone network; an extranet; an intranet; and so on. However, this list is provided by way of example only and is not meant to limit the present disclosure. Further, the communications interface can be configured to communicate with a single network or multiple networks across different access points. In a specific embodiment, a communications interface can transmit information from the controller to an external device (e.g., a cell phone, a computer connected to a Win network, cloud storage, etc.). In another specific embodiment, a communications interface can receive information from an external device (e.g., a cell phone, a computer connected to a WiFi network, cloud storage, etc.).

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A method for humidifying a laser-ablated sample, comprising:

generating a water vapor stream;

transferring the water vapor stream to at least one of a sample chamber of a laser ablation device or a mixing chamber in fluid communication with the laser ablation device, wherein the laser ablation device is configured to transfer a laser-ablated sample to the mixing chamber;

transferring the laser-ablated sample to an inductively coupled plasma torch;

ionizing at least a portion of the laser-ablated sample with the inductively coupled plasma torch to create an analyte stream; and detecting at least one analyte of interest in the analyte stream.

2. The method of claim 1, wherein generating a water vapor stream includes transferring water vapor, via a pump, to a transfer gas stream.

3. The method of claim 2, wherein transferring water vapor, via a pump, to a transfer gas stream includes transferring water vapor, via the pump, to the transfer gas stream at a rate of 1 to 100 μL/min.

4. The method of claim 2, wherein the pump is a syringe pump.

5. The method of claim 1, wherein generating a water vapor stream includes:

transferring fluid from a water-vapor containing flow source via a first flow channel separated from a second flow channel via a channel membrane.

6. The method of claim 5, wherein the channel membrane is a selectively permeable membrane configured to permit water vapor to cross therethrough into the second flow channel.

7. The method of claim 6, further including:

flowing an inert gas into the second flow channel, the flow of the inert gas configured to carry the water vapor crossing into the second flow channel to produce the water vapor stream.

8. The method of claim 1, wherein detecting at least one analyte of interest in the analyte stream includes detecting at least one of thorium and uranium in the analyte stream.

9. The method of claim 1, wherein detecting at least one analyte of interest in the analyte stream includes detecting each of thorium and uranium in the analyte stream.

10. A method for humidifying a laser-ablated sample, comprising:

generating a water vapor stream; and transferring the water vapor stream to at least one of a sample chamber of a laser ablation device or a mixing chamber in fluid communication with the laser ablation device, wherein the laser ablation device is configured to transfer a laser-ablated sample to the mixing chamber.

11. The method of claim 10, wherein generating a water vapor stream includes transferring water vapor, via a pump, to a transfer gas stream.

12. The method of claim 11, wherein transferring water vapor, via a pump, to a transfer gas stream includes transferring water vapor, via the pump, to the transfer gas stream at a rate of 1 to 100 μL/min.

13. The method of claim 11, wherein the pump is a syringe pump.

14. The method of claim 10, wherein generating a water vapor stream includes:

transferring fluid from a water-vapor containing flow source via a first flow channel separated from a second flow channel via a channel membrane.

15. The method of claim 14, wherein the channel membrane is a selectively permeable membrane configured to permit water vapor to cross therethrough into the second flow channel.

16. The method of claim 15, further including:

flowing an inert gas into the second flow channel, the flow of the inert gas configured to carry the water vapor crossing into the second flow channel to produce the water vapor stream.

17. The method of claim 10, wherein detecting at least one analyte of interest in the analyte stream includes detecting at least one of thorium and uranium in the analyte stream.

18. The method of claim 10, wherein detecting at least one analyte of interest in the analyte stream includes detecting each of thorium and uranium in the analyte stream.

* * * * *